United States Patent [19]

Miller

[11] 4,141,514

[45] Feb. 27, 1979

[54] STANDBY CHUCK OPERATING MECHANISM

[75] Inventor: Harry B. Miller, Charlotte, N.C.

[73] Assignee: Industrie-Werke Karlsruhe Augsburg Aktiengesellschaft, Fed. Rep. of Germany

[21] Appl. No.: 896,051

[22] Filed: Apr. 13, 1978

[51] Int. Cl.[2] ..... B65H 54/02; B65H 54/42; B65H 67/04

[52] U.S. Cl. ..... 242/18 A; 242/18 DD

[58] Field of Search ..... 242/18 A, 18 DD, 18 PW, 242/25 A

[56] References Cited

U.S. PATENT DOCUMENTS

| | | | |
|---|---|---|---|
| 2,957,635 | 10/1960 | Bisbe | 242/18 A |
| 3,334,827 | 8/1967 | Jackson | 242/18 A |
| 3,628,741 | 12/1971 | Enneking et al. | 242/18 DD |
| 3,642,217 | 2/1972 | Sistare et al. | 242/18 DD X |
| 3,697,007 | 10/1972 | Taylor et al. | 242/18 A X |
| 3,845,911 | 11/1974 | Wyatt | 242/18 DD |
| 3,876,161 | 4/1975 | Miller | 242/18 A |

FOREIGN PATENT DOCUMENTS

| | | | |
|---|---|---|---|
| 2523771 | 12/1975 | Fed. Rep. of Germany | 242/18 A |

*Primary Examiner*—Stanley N. Gilreath
*Attorney, Agent, or Firm*—McGlew and Tuttle

[57] ABSTRACT

The mechanism provides for winding much larger yarn packages of each of a pair of vertically spaced chucks on one side of a common drive roll and displaceable alternately horizontally into engagement with the drive roll for winding of yarn packages on bobbins on the chucks. A belt is trained around the drive roll and around an adjustably mounted small diameter pulley located between the two chucks. When a package has begun to be wound on a bobbin on one chuck by rotation by the common drive roll, the other chuck is moved inwardly, from a retracted position, past the partially wound package to a standby position in which it is adjacent but out of contact with the belt. As the package nears completion, the standby chuck is engaged with the "soft" part of the belt, between the drive roll and the pulley, and accelerated to bring its peripheral velocity into substantial synchronism with that of the drive roll. When the package has been substantially completely wound, the standby chuck is engaged directly with the part of the belt in contact with the drive roll, and the yarn is transferred from the package to the bobbin on the standby chuck for winding of a new yarn package. As no clearance is required for the standby chuck to be brought past the fully wound package, the package can be wound to a much larger diameter. The mechanism is applicable to a high speed winder including two pairs of chucks, each with a common drive roll, with the pairs of chucks disposed on opposite sides of a traverse mechanism support.

10 Claims, 1 Drawing Figure

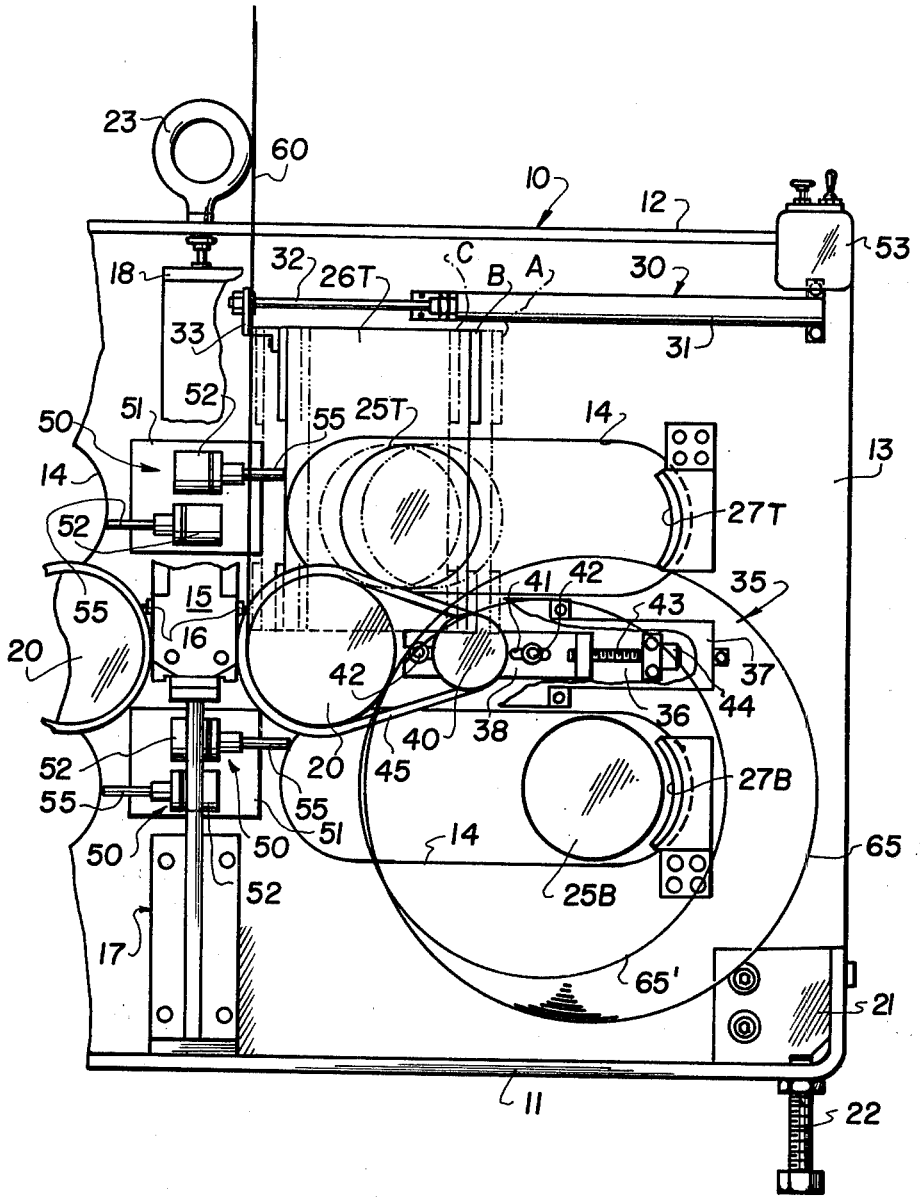
23
60
10
12
53
18
32
26T
C
B
A
30
33
31
52
51
50
55
25T
14
13
14
27T
52
41
42
35
55
15
43
16
20
42
37
44
36
40
38
52
20
45
27B
55
55
51
14
65
50
50
52
25B
17
65'
21
11
22

STANDBY CHUCK OPERATING MECHANISM

FIELD AND BACKGROUND OF THE INVENTION

Modern winders, for winding yarn into yarn packages on bobbins mounted on chucks, generally include two or more rotatable chucks each supporting one or more bobbins. The chucks are usually arranged in pairs on opposite sides of the support or housing for a yarn traverse mechanism, with each pair being associated with a common drive roll positioned adjacent the traverse support or housing. While one chuck is being rotated for winding of yarn into packages on bobbins mounted thereon, empty bobbins are placed on the second chuck which is then in a standby condition. When full packages have been wound on the first chuck, the yarn is transferred to bobbins on the second chuck and the first chuck is brought to a stop, after which the full packages are removed therefrom.

The fed yarn can be transferred from a full package to an empty bobbin or bobbins on the second chuck manually by a winder operator or attendant, who has to thread the yarn properly for winding on the bobbins or tubes on the second chuck. The threading of the yarn is usually effected by feeding the end of the yarn into an aspirator or the like, and then using a "doffer" to engage the yarn and the traverse guides for proper winding in a criss-cross manner on the bobbins on the chucks. However, such manual re-threading or re-guiding of the yarn, when full packages have been wound, so that the yarn can begin to be wound on empty bobbins, requires a considerable amount of time and, more importantly, a substantial waste of yarn, particularly when yarns are being fed at very high speeds.

A much faster and very highly efficient transfer of yarn from a full package on one chuck of a pair to an empty bobbin on the other chuck of the pair can be effected by the mechanism and method shown, described, and claimed in the Inventor's co-pending U.S. Patent application, Ser. No. 809,676, filed June 24, 1977, and by the mechanism and method shown, described and claimed in the Inventor's U.S. Patent Application Ser. No. 690,967, filed May 28, 1976, now U.S. Pat. No. 4,081,149.

In both these methods and mechanisms, the previously inactive chuck is accelerated to a high angular velocity before the yarn is transferred from the full package to an empty bobbin on the now rotating but previously inactive chuck. In order to effect high speed rotation of the previously inactive chuck, the latter, or the bobbin or bobbins thereon, must be brought into driving engagement with the common drive roll. It is thus necessary to move the inactive chuck horizontally, from an inactive and retracted position, past the package being wound on the then active chuck and into engagement with the drive roll for rotation by the latter. The necessity of leaving sufficient clearance for the inactive chuck, with a bobbin or bobbins mounted thereon, to be moved horizontally past a yarn package being wound on an active chuck, has limited seriously the diameter of the package being wound on the active chuck.

This limitation as to the size of the package which can be wound is of great importance when it is considered that the sector of the textile industry which involves man-made fiber production is becoming more competitive year by year with foreign production and more competitive internally. As a result, there is a great necessity to improve production speeds with a minimum cost of capital equipment. To attain these ends, the man-made fiber processors are constantly expanding their capability of making yarn at higher spinning speeds and with more threads per spinning position. Because there are now more threads per spinning position, the bottleneck for this expansion is the requirement for a winder which has higher speed capability and winds more and larger packages.

In order to be able to use existing spinning processing machinery and plant facilities, such a winder is a key objective. Without such a winder, completely new process facilities and plant facilities have to be built at continually higher costs for machinery.

The present invention is directed to making it possible to wind yarn at higher speeds and to obtain more and acceptably larger packages per winder.

SUMMARY OF THE INVENTION

The objective of the invention is to provide for the winding of much larger packages, within the same width or guage, on existing winders having either two vertically spaced chucks cooperable with a common drive roll or, as is more characteristic of high speed winders, two pairs of such chucks with each pair being associated with a common drive roll, one pair being located on one side of a support for a traverse mechanism and the other pair being located on the other side thereof.

Considering the case of two vertically spaced chucks associated with a common drive roll, yarn stringup is effected in a manner which will now be described. When it is desired to transfer yarn, being wound into a package on a bobbin on one chuck, to a bobbin on the other chuck, which is then inactive, the inactive chuck is brought into engagement with the common drive roll and, when its peripheral velocity is equal to that of the active chuck, the yarn is cut loose from the active chuck which is still winding a package, and is then quickly strung up on the bobbin on the inactive chuck to start winding with a minimum of waste yarn.

As mentioned, in the past it has been the practice to bring the inactive chuck, carrying empty bobbins, past the full package and into engagement with the drive roll after the package on the active chuck has come to a predetermined size. This procedure puts a limitation on the size of the package, because the package size is determined by the necessity of providing sufficient clearance to move the inactive chuck, carrying the empty bobbins, past the package being wound and without interfering with the package.

Stated briefly, in accordance with the present invention, the inactive chuck, carrying empty bobbins, is moved from a fully retracted position to a "standby" position shortly after the beginning of winding of packages on bobbins on the active chuck. As the package or packages near completion, the inactive chuck is acclerated until its peripheral speed, or that of the bobbins thereon, is substantially synchronous with that of the common drive roll and, as the winding of packages on the active chuck is completed, the inactive chuck, or its bobbins, is brought into engagement with the drive roll and the yarn is then quickly transferred from the package or packages then being wound to the empty bobbin or bobbins on the inactive chuck now rotating at high speed. Thus, and as the inactive chuck has already "cleared" the package being wound on the active chuck, the package or packages can be wound to a much greater diameter and a much larger weight of yarn as there is no necessity for providing "clearance" for movement of the inactive chuck from a retracted position to a position in which it is engaged with the common drive roll. The previously active chuck, on which packages have been fully wound, is then retracted from the common drive roll to its retracted position and comes to a stop, after which the package or packages can be removed therefrom therefrom or "doffed".

More specifically, in the present invention, a belt is trained around the common drive roll and engaged with a much smaller diameter pulley spaced somewhat from the common drive roll toward the retracted positions of the chucks. This pulley is preferably mounted for adjustment so that the tension of the belt may be readily adjusted. In the initial operation, and after the winding of a package has been intiated on one chuck, hereinafter referred to as the active chuck, the inactive chuck is brought from its fully retracted position to a position closely adjacent but out of contact with the belt. When the package being wound approaches completion, the inactive chuck is brought into engagement with a "soft" part of the belt so that the inactive chuck may be accelerated to a peripheral velocity which is substantially synchronous with that of the belt and the common drive roll. As winding of the package is fully completed, the inactive chuck is brought into direct engagement with the belt trained around the drive roll, or with the drive roll itself, and the yarn is transferred from the fully wound package to bobbins on the inactive chuck.

For the purpose of controlling the displacement of the inactive chuck, air cylinders are mounted on the support for the traverse mechanism, and have plungers which can be extended outwardly therefrom. Initially, these plungers are fully extended so that they engage the supporting structure for the inactive chuck when the supporting structure has been moved toward the support for the traverse mechanism an amount such that the inactive chuck is adjacent but still out of contact with the belt. When the package being wound nears completion, the plunger is retracted a further amount so that the inactive chuck can be brought into contact with the "soft" part of the belt for acceleration to a peripheral speed which is substantially equal to that of the common drive roll. As the package is completed, the plunger is retracted further so that the inactive chuck can be brought into direct engagement with that part of the belt engaged with the common drive roll or even with the common drive roll, after which the yarn is transferred from the fully wound package to a bobbin or bobbins on the inactive chuck for the beginning of a new package or packages. The active chuck, meanwhile, has been retracted from the common drive roll to its fully retracted position, where it may be brought to a stop by a suitable brake or the like, and the package or packages thereon may be "doffed" at any time. The same procedure is then repeated with respect to the previously active chuck which is now the "inactive" chuck.

It should be noted that, in modern high speed winders, the chucks are mounted, as by roller bearings or the like, in a chuck support structure for horizontal movement, in elongatedslots in a vertical plate, between a fully retracted position and a position in which the chucks are engaged with the common drive roll. Such movement is usually effected by fluid pressure linear actuaters, such as piston-cylinder actuators which may be operated either by air under pressure or by hydraulic fluid.

An object of the invention is to provide an improved method and apparatus whereby much larger packages may be wound on existing winders and within the same width or gauge.

Another object of the invention is to provide such a method and apparatus in which the size of the package being wound is not limited by the necessity for providing clearance for movement of an inactive chuck past the package to engage the common drive roll.

A further object of the invention is to provide such a method and apparatus which is highly efficient, low in capital costs, and rugged in operation.

For an understanding of the principles of the invention, reference is made to the following description of a typical embodiment thereof as illustrated in the accompanying drawing.

BRIEF DESCRIPTION OF THE DRAWING

In the drawing, the single FIGURE is an end elevation view, with some parts omitted, of a high speed yarn winder incorporating the improvements of the present invention.

DESCRIPTION OF THE PREFERRED EMBODIMENT

Referring to the drawing, an essentially conventional, high speed, four chuck yarn winder generally indicated at 10, is partially illustrated as including a base 11, a cover 12, and an upright wall 13 extending between base 11 and the cover 12. Wall 13 is formed with two vertically spaced, horizontally elongated slots 14, 14, for a purpose to be described. A traverse mechanism or assembly 15, having traverse guides 16 for yarns, on opposite sides thereof, is illustrated as mounted on a traverse assembly support 17 which is, in turn, supported on base 11 at substantially the center thereof. Support brackets 21, only one of which is illustrated, connect base 11 to upright wall 13, and adjustable studs 22 are provided on base 11. To provide for ready movement of winder 10 to other locations, an eye bolt 23 is secured to cover 12.

Drive rolls 20, 20, each driven in a conventional manner, are provided on opposite sides of traverse assembly or mechanism 15, and each drive roll is common to a respective pair of chucks 25T and 25B, these chucks being spaced vertically from each other and being movable, in respective slots 14, between a fully retracted position, at the right ends of these slots as viewed in the figure, and an active position in which they are engaged with the common drive roll 20. As the arrangement to the left of traverse mechanism or assembly 15 is essentially a mirror image of that to the right, only the arrangement to the right of the traverse assembly will be described. The winder may be provided with a "transfer tails" mechanism 18 mounted on support 17, such a transfer tails mechanism being shown in the Inventor's co-pending application Ser. No. 690,967 now U.S. Pat. No. 4,081,149.

In accordance with conventional practice, each chuck 25T or 25B is rotatably supported in a respective chuck support 26T, 26B, but, for clarity, only the support 26T for the upper chuck 25T has been shown in the drawing. It will be understood that a corresponding support 26B is provided for the lower chuck 25B. At the right hand end of each slot 14 there is a respective chuck brake 27T, 27B, with which the chuck may be engaged when moved to its fully retracted position, to decelerate the chuck to a standstill for "doffing" of wound packages therefrom. Each chuck is shifted by a suitable fluid-pressure linear actuator 30, including a cylinder 31 in which there is displaceable a piston secured to a piston rod 32 extending to the left from cylinder 31, and having secured, to its outer or left end, a bracket 33 which is, in turn, secured to a chuck support 26, such as the support 26T. The linear actuators 30 may be operated by air under pressure or by hydraulic fluid. All of the mechanism so far described is essentially conventional in high speed, four-chuck yarn winders, so that further detailed description is believed unecessary. However, it should be noted that the chuck supports 26 are suitably mounted, for sliding movement, on horizontally extending rails or the like.

In accordance with the invention, a pulley support 35 is mounted on the upright wall 14 substantially midway between the slots 14, 14. Pulley support 35 includes a horizontally oriented support bracket 36 secured to the wall 13 and provided with a cover 37. A horizontally oriented adjustable bracket 38 is slidably mounted on support bracket 36 through the medium of elongated slots 41, in bracket 38, receiving bolts or studs 42 threaded into support bracket 36. An adjusting screw 43 is rotatably mounted on support 36 and is threaded into bracket 38, adjusting screw 43 being provided with an easily and readily accessible operating head 44. By loosening bolts or studs 42, bracket 38 may be adjusted longitudinally of bracket 36 a predetermined amount, and thereafter secured in adjusted position by tightening bolts or studs 42. The purpose of this will presently be described.

A small diameter pulley 40 is rotatably mounted on bracket 38, and a belt 45 is trained around pulley 40 and common drive roll 20, so that pulley 40 is driven by drive roll 20 through the medium of belt 45. By the adjustment of bracket 38 just mentioned above, the tension on belt 45 can be maintained as desired. Belt 45 is preferably an elastomer belt, such as a belt of natural or artificial rubber or the like. The portion of belt 45 between drive roll 20 and pulley 40 is relatively "soft", whereas those portions of belt 45 in direct engagement with drive roll 20 and pulley 40 are "hard" portions of belt 45, considered from the standpoint of the amount of "give" in the belt. In a manner to be described hereinafter, both the "soft" and the "hard" portions of belt 45 are used to rotate the inactive chuck, that is the chuck, such as the chuck 25T, not then having a yarn package wound thereon.

As previously mentioned, immediately after starting of the winding of a yarn package, such as the package 65 on a bobbin on an active chuck, such as the chuck 25B, the inactive chuck, such as the chuck 25T is moved from a fully retracted position, in which it is engaged with its brake 27, to a "standby" position in which it is adjacent but out of contact with the belt 45, after which the inactive chuck 25T is moved into contact with a "soft" portion of belt 45 and later into contact with a "hard" portion of belt 45, namely that portion in contact with drive roll 20. For the purpose of setting each of these three positions of the inactive chuck 25T, a limit device 50 is provided. There are four of these limit devices 50, each associated with a particular chuck, namely the two chucks on the right hand side of the traverse mechanism support 17 and the two chucks on the left hand side thereof. For this purpose, a pair of substantially rectangular plates or brackets 51 are mounted on the traverse mechanism support 17 in vertically spaced relation to each other, and each plate or bracket 51 supports two limit devices 50, one directed to the right and the other directed to the left. Each limit device comprises a respective air cylinder 52 enclosing a reciprocable piston secured to a plunger 55 projecting outwardly from the air cylinder 52. These plungers 55 are arranged to engage and stop the associated chuck support 26 so that the chuck support 26, when actuated by the shifting actuator 30 to move the chuck 25T, for example, from a fully retracted position into engagement with the drive roll 20 or with the belt 45 thereon, a chuck support 26 is stopped in three different positions. Control of the extent of projection of the plungers 55 is effected by a switch assembly generally indicated at 53.

In the first position, which is then dash-double dot line position A, the plunger 55 of limit device 50 associated with the upper chuck 25T is fully extended so that, when upper chuck support 26T is moved to the left by supply of pressure to linear actuator 30, plunger 55 will engage and stop chuck support 26T in the position A. In position A, chuck 25T, as indicated by the dash-double dot line, is adjacent but one of contact with the belt 45 and has passed by the partially formed yarn package 65 before the latter has attained any sizeable diameter. This is the "standby" position of the inactive chuck 25T carrying an empty bobbin or bobbins.

When the package 65, being wound on a bobbin on lower chuck 25B, nears completion, a signal is given to limit device 50 and linear actuator 30, associated with chuck 25T. As a result, plunger 55 is retracted to an intermediate position, and linear actuator 30 is supplied with operating fluid under a low pressure. Thus, chuck support 26T is moved to position B where it is halted by plunger 55, position B being shown in solid lines. In this position, chuck 25T, also shown in solid lines, is engaged under a very low pressure with a "soft" portion of belt 45, for a "soft start-up" avoiding the high friction of a "hard start-up" that would prematurely wear belt 45 and might possibly destroy a bobbin or bobbins on chuck 25T. In position B, chuck 25T is accelerated to a peripheral speed which is substantially synchronous with the peripheral speed of belt 45 and thus substantially synchronous with th peripheral speed of common drive roll 20.

When yarn package 65 is substnatially fully wound, a further signal is given to the limit device 50 in linear actuator 30 associated with upper chuck 25T, resulting in complete retraction of plunger 55 and an increase in the pressure supplied to linear actuator 30. As a result, upper chuck support 26T is moved to the dash dotted-line position C by actuator 30, with chuck support 26T engaging the upper bracket 51. Chuck 25T, or the bobbins thereon, are now engaged with a "hard" portion of belt 45 in contact with drive roll 20. The "hard" portion of the belt 45 slightly increases the effective radius of drive roll 20 to result in over-driving chuck 25T slightly to develop tension for start-up. However, such increased radius is not great enough to last much past the start of formation of a package, before the yarn winding on the bobbin is thick enough to start driving the chuck directly through the yarn engaging drive roll 20. With the yarn feed being transferred from package 65 to the empty bobbin or bobbins on chuck 25T for winding of a new yarn package or packages, chuck 25B is moved, by its associated linear actuator, into its fully retracted position where it is brought to a stop by the associated brake 27B so that yarn package 65 may be doffed therefrom.

During winding of a new yarn package or packages on the upper chuck 25T, or respectively on a bobbin or bobbins thereon, the lower chuck 25B becomes the "inactive" chuck and the same procedure is followed for bringing the lower chuck 25B first into a position adjacent but out of contact with the belt 45, then into contact with a "soft" portion of the belt 45, and finally into contact with that "hard" portion of belt 45 which is in contact with common drive roll 20. It will be noted that the yarn 60 is fed around and beneath the common drive roll 20 and then around and over the then active chuck or, respectively, the bobbin or bobbins thereon. Transfer of the yarn may be effected either manually or by the apparatus previously mentioned.

For comparison purposes, and to illustrate the invention advantages more clearly, the usual small diameter yarn package 65' wound on a winder 10 not having the improvement of the invention is illustrated to show a comparison with the yarn package 65 wound on the conventional high speed four-chuck winder 10 equipped with the improvement of the invention. The smaller diameter yarn package 65', which may be referred to as the "normal" package, has a 10⅜" diameter and weighs, with one type of yarn, 19.3 lbs, this being the maximum size package possible to be wound without using the "standby" chuck arrangement of the present invention. By contrast, the package 65 wound, using the "standby" chuck mechanism of the invention has a diameter of 12.5" and, with the same yarn as wound on the package 65', has a weight of 30 lbs, so that the larger diameter package 65 contains over 50% more yarn than the smaller diameter package 65'.

While a specific embodiment of the invention has been shown and described in detail to illustrate the application of the principles of the invention, it will be understood that the invention may be embodied otherwise without departing from such principles.

What is claimed is:

1. In a winder for yarn or the like including at least one pair of vertically spaced chucks, a common drive roll intermediate the chucks for rotating the chucks by engagement therewith or with a yarn package being wound on a bobbin mounted thereon, traverse means operable to cross-wind a yarn package on a bobbin, and respective means mounting each chuck for horizontal displacement from a retracted position, in which the associated chuck is spaced substantially from the common drive roll, and an active position in which the associated chuck, or a yarn package thereon, is in engagement with the drive roll, and vice-versa, and in which the yarn is fed to a bobbin, engaged with the drive roll, on an active chuck of each pair, to wind a yarn package thereon, while the other chuck of each pair is retracted from the drive roll, and is inactive, with the active chuck being displaced toward its retracted position as the yarn package increases in size, and with the yarn feed being transferred from the yarn package, when the latter is substantially fully wound, to the bobbin on the inactive chuck for winding of a new package thereon after such bobbin has been brought into contact with the drive roll to be rotated at high speed, with the size of the completed yarn package being limited due to the clearance needed for displacement of the inactive chuck and the bobbin thereon past the yarn package to engage the empty bobbin on the empty chuck with the drive roll: the improvement comprising, in combination, respective chuck displacing means operatively associated with each mounting means; the associated chuck displacement means operatively associated with an inactive chuck being operable to move the latter toward said common drive roll and past the yarn package being wound on the bobbin on the active chuck, while such yarn package has only a relatively small diameter, to a standby position closely adjacent to but out of contact with said common drive roll; said associated chuck displacement means, when such package is nearly fully wound, moving the inactive chuck from its standby position to a position in which the bobbin thereon engages said common drive roll; whereby yarn packages of substantially larger diameter can be wound on said chucks by virtue of the fact that the inactive chuck does not have to be moved past a substantially fully wound package from its retracted position to engage an empty chuck thereon with said common drive roll.

2. A winder for yarn or the like, as claimed in claim 1, including limiting means having a first position limiting movement of the inactive chuck, by its displacement means, to said standby position; said limiting means, when such package is nearly fully wound, retracting to a position in which the bobbin on the inactive chuck can engage said common drive roll.

3. A winder for yarn or the like, as claimed in claim 2, including a respective pulley intermediate the chucks of each pair and spaced horizontally from said common drive roll, said pulley having a diameter substantially smaller than that of said common drive roll; and a belt trained around said pulley and said common drive roll for driving of said pulley by said common drive roll; said inactive chuck, in the first position of said limiting means, being closely adjacent to but out of contact with said belt and, in such retracted position of said limiting means, being in contact with said belt.

4. A winder for yarn or the like, as claimed in claim 3, in which said inactive chuck, in a second position of said limiting means is in engagement with a "soft" portion of said belt intermediate said common drive roll and said pulley; said limiting means retracting to a third position, when a package is fully wound, providing for movement of said inactive chuck, by its displacement means, to a position in which the bobbin thereon engages that portion of said belt in contact with said common drive roll.

5. A winder for yarn or the like, as claimed in claim 4, including a support for said traverse means, said limiting means comprising respective fluid pressure operated linear actuators operatively associated with each chuck and mounted on said traverse means support; each linear actuator including a cylinder and a plunger extending from said cylinder toward the chuck mounting means of the associated chuck and engageable with the associated chuck mounting means in each of said three positions of said limiting means.

6. A winder for yarn or the like, as claimed in claim 3, including means mounting said pulley for adjustment toward and away from said common drive roll to adjust the tension on said belt, and including readily accessible pulley adjusting means.

7. A winder for yarn or the like, as claimed in claim 3, including a winder framework; each chuck displacing means comprising a respective fluid pressure operated linear actuator which is horizontally oriented and includes a cylinder and a piston rod extending from a piston in said cylinder; each linear actuator being secured at one end to said framework and at its opposite end to the chuck mounting means of the associated chuck.

8. In a winder for yarn or the like including at least one pair of vertically spaced chucks, a common drive roll intermediate the chucks for rotating the chucks by engagement therewith or with a yarn package being wound on a bobbin mounted thereon, traverse means operable to cross-wind a yarn package on a bobbin, and means mounting each chuck for horizontal displacement toward and away from the common drive roll: the method of cross-winding a yarn package on an active chuck of each pair while the other chuck of each pair is inactive comprising the steps of feeding the yarn to a bobbin, engaged with the common drive roll, on the active chuck, for winding of a yarn package thereon; while such yarn package has only a relatively small diameter, moving the inactive chuck, from its fully retracted position, toward the common drive roll and past the yarn package into a standby position in which the inactive chuck is closely adjacent to but out of contact with the common drive roll; when the package is nearly fully wound, moving the inactive chuck to a position in which a bobbin thereon engages the common drive roll for rotation thereby; and, when the yarn package on the active chuck is completely wound, transferring the yarn feed from the completely wound yarn package to the empty bobbin on the inactive chuck; whereby yarn packages of substantially larger diameter can be wound on the chucks by virtue of the fact that the inactive chuck does not have to be moved past a substantially fully wound package.

9. The method claimed in claim 8, including the step of, in advance of moving the inactive chuck from its standby position in which it is closely adjacent to but out of contact with the common drive roll to a position in which an empty bobbin thereon is engaged with the common drive roll, accelerating the inactive chuck until its peripheral speed is substantially synchronized with the peripheral speed of the common drive roll.

10. The method claimed in claim 9, including the steps of providing a pulley intermediate the active and inactive chucks and spaced horizontally from the common drive roll, the pulley having a diameter substantially smaller than that of the common drive roll; training a belt around the common drive roll and said pulley for rotation of said pulley by the common drive roll; initially moving the inactive chuck from its fully retracted position into a standby position closely adjacent to but out of contact with a portion of the belt intermediate the common drive roll and the pulley; then moving the inactive chuck into engagement with the "soft" portion of the belt between the common drive roll and the pulley; and finally moving the inactive chuck into engagement with that portion of the belt in contact with the common drive roll.

* * * * *